United States Patent [19]

Theurer et al.

[11] 4,432,284

[45] Feb. 21, 1984

[54] MOBILE BALLAST CLEANING MACHINE

[75] Inventors: Josef Theurer, Vienna; Karl Fölser, Linz; Klaus Riessberger, Wolfgang Zeppelzauer, Wilfried Glawischnig, all of Vienna, Austria

[73] Assignee: Franz Plasser Bahnbaumaschinen-Industriegesellschaft m.b.H., Vienna, Austria

[21] Appl. No.: 287,532

[22] Filed: Jul. 27, 1981

[30] Foreign Application Priority Data

Jul. 31, 1981 [AT] Austria ..... 3981/80

[51] Int. Cl.[3] ..... E01B 27/11

[52] U.S. Cl. ..... 104/7 R; 104/2; 33/287; 33/378; 171/16

[58] Field of Search ..... 104/7 R, 7 A, 8, 7 B, 104/2; 171/16; 33/1 Q, 287, 338, 377, 378, 366, 367; 37/104–107

[56] References Cited

U.S. PATENT DOCUMENTS

| | | | |
|---|---|---|---|
| 2,814,127 | 11/1957 | Blatchford | 33/367 |
| 3,494,299 | 2/1970 | Boyer | 104/7 R |
| 3,926,123 | 12/1975 | Plasser et al. | 104/7 R |
| 3,949,484 | 4/1976 | Cluley et al. | 33/367 |
| 4,267,777 | 5/1981 | Theurer et al. | 171/16 |

FOREIGN PATENT DOCUMENTS

| | | | |
|---|---|---|---|
| 247899 | 6/1966 | Austria . | |
| 256914 | 9/1967 | Austria . | |
| 56-82408 | 7/1981 | Japan | 33/366 |
| 1067465 | 5/1967 | United Kingdom . | |

OTHER PUBLICATIONS

"Rugged Undercutter Ballast Cleaner", *Progressive Railroading*, Sep. 1977, pp. 131–133.

*Primary Examiner*—Randolph Reese
*Assistant Examiner*—Donald Hajec
*Attorney, Agent, or Firm*—Kurt Kelman

[57] ABSTRACT

A mobile ballast cleaning machine mounted on a track for movement in an operating direction incorporates apparatus for continuously measuring parameters indicating the track position and any changes therein with respect to a reference system caused by ballast excavation, and for recording the measured parameters. This apparatus comprises hydrostatic level measuring devices mounted in the region of the front and rear undercarriages at the laterally extending sides of the machine frame, two further hydrostatic level measuring devices transversely spaced apart and mounted in the laterally outermost regions of the endless ballast excavating chain, an additional hydrostatic level measuring device mounted in the region of a track sensing element arranged on the frame forwardly of the front undercarriage, and a conduit connected to the hydrostatic level measuring devices for delivering a liquid thereto. The devices comprise emitters of electrical output signals corresponding to the measured parameters whereby the apparatus is capable of providing a reference base for the parameters superelevation, inclination and lowering of the track level.

20 Claims, 5 Drawing Figures

MOBILE BALLAST CLEANING MACHINE

The present invention relates to a mobile ballast cleaning machine mounted on a track for movement in an operating direction. Known machines of this type comprise an elongated frame having two laterally extending sides, a front undercarriage and a rear undercarriage supporting the frame at respective ends thereof on the track and track lifting means mounted on the frame. An endless ballast excavating chain is mounted on the frame and extends in an inclined plane with respect to the track and the chain comprises a course extending transversely of the track and, during operation, therebelow, the transverse endless ballast excavating chain course having laterally outermost end regions, and two lateral courses rising from the end regions in the inclined plane. Power drive means, such as hydraulic jacks, link the ballast excavating chain to the frame for vertically and transversely adjustably positioning the chain with respect to the frame and means are mounted on the frame for cleaning the ballast excavated by the chain and for redistributing the cleaned ballast under the track. It is also known to equip such ballast cleaning machines with apparatus for continuously measuring parameters indicating the track and corresponding ballast bed position and any changes therein with respect to a reference system caused by the ballast excavation, and for recording and, optionally, indicating the measured parameters, such apparatus including measuring devices comprising means for emitting electrical output signals corresponding to the measured parameters.

British Pat. No. 1,067,465, published May 3, 1967, discloses a mobile ballast cleaning machine wherein the ballast excavating chain may be vertically and transversely repositioned by power drives so that the transverse chain course, which constitutes the actual excavating element immersed in the ballast below the track, may be readily and easily adjusted to the desired excavating depth and so as to avoid any obstacles present in the ballast bed. In the operation of such a machine, the ultimate condition of the reconditioned track section, such as the level and superelevation of the track and ballast bed, depends on numerous parameters, including the original track position, the excavating depth and transverse inclination of the excavating element with respect to the track plane, the distribution of the cleaned and any additional ballast returned to the excavated bed over the entire width of the ballast bed and the positioning of any ballast planing and compacting devices used to level and consolidate the redistributed ballast. Since most of these parameters cannot be judged objectively by the operator of the machine, the ultimate track position and any deviation thereof from a desired level depend primarily on the know-how and experience of the operating personnel. However, even the most experienced operators cannot avoid some track position errors, particularly errors in the track grade and superelevation in track curves. Such errors must then be corrected in costly operations subsequent to the ballast cleaning by means of mobile track leveling, lining and tamping machine to make the reconditioned track ready for high-speed train traffic.

Austrian Pat. No. 247,899, dated Nov. 15, 1965, relates to a ballast bed reconditioning apparatus operating on a trackless bed. The operating position of the machine with respect to level and superelevation may be controlled by pairs of interconnected and communicating tubes, one of the tubes being arranged above a fixed point while the other tube of the pair is vertically adjustably supported on the machine. The machine position is adjusted according to the liquid level in these control tubes by means of adjustable measuring rods at points in the path of the machine spaced apart about one meter. This procedure is relatively complex and time consuming. The control tube which determines the operating level must be re-set from one fixed point to the next and the measuring apparatus must then be re-adjusted so that a continuous operation is impossible. In the modification of this apparatus disclosed in Austrian Pat. No. 256,914, dated Jan. 15, 1967, parts of inter-connected and communicating level control tubes are arranged on the axles of the machine. The measured parameters are converted into electrical measuring signals which may be used subsequently for adjusting the level and superelevation of the machine.

U.S. Pat. No. 3,494,299, dated Feb. 10, 1970, discloses a mobile ballast cleaning machine running on a track. The machine frame carries the operating equipment, which may be adjustably repositioned relative to the frame, and the frame is supported on the undercarriages by means of jacks which enable the longitudinal and transverse inclination of the frame with respect to the track to be adjusted. Numerous level measuring devices are mounted on the machine frame, its two undercarriages and the frame of a tractor to which the machine frame is coupled, and these devices, which are mechanical pendulums connected to the machine frame a predetermined level and superelevation. In this system, the machine frame itself forms a reference for the adjustment of the operating equipment of the machine. This mechanical system has many structural and functional disadvantages. The jacking support of the machine frame on its undercarriages and the required equipment for controlling the operation of these support jacks in dependence on the measured values of the level measuring devices involve costly structures. Using the machine frame as a reference for such a mechanical measuring system may also have disadvantages since the frame of a ballast cleaning machine is subject to uncontrollable vibratory forces during the ballast excavating operation. Furthermore, the machine frame supporting jacks are subjected not only to the very heavy weight of the frame and the operating equipment carried thereby but also to the ballast reaction forces effective particularly in a transverse direction. The system is not capable to meet the requirements as to accuracy and dependability set by various railroad administrations.

It is the primary object of this invention to improve mobile ballast cleaning machines of the above-indicated type in a manner taking full account of the relatively difficult structural and operational conditions involved in these heavy machines while enabling the decisive track position parameters to be measured and used more readily and accurately to adjust the ballast excavating equipment so as to assure the desired track position.

In a mobile ballast cleaning machine of the first-described type, this and other objects are accomplished according to the invention with an apparatus for continuously measuring parameters indicating the track position and any changes therein with respect to a reference system caused by the ballast excavation, and for recording the measured parameters, which apparatus comprises hydrostatic level measuring devices mounted in the region of the front and rear undercarriages at the laterally extending sides of the frame, two further hydrostatic level measuring devices transversely spaced apart and mounted on the lateral course near the laterally outermost regions of the endless ballast excavating chain, and an additional hydrostatic level measuring device mounted in the region of a track sensing element arranged on the frame forwardly of the front undercarriage. Conduit means connected to the hydrostatic level measuring devices delivers a liquid thereto, the devices comprising means for emitting electrical output signals corresponding to the measured parameters whereby the apparatus is capable of providing a reference base for the parameters superelevation, inclination and lowering of the track level.

This arrangement for the first time provides a physically stable and absolute reference system which is substantially independent of uncontrollable influences, such as operating forces and controls, and which measures and records with the greatest precision all track parameters required for obtaining a desired track position with the accuracy demanded by the railroads. The exact measurement of the differences of the level of the track or track bed and of the operating equipment in relation to the liquid level determining the reference plane is made very simple by the provision of the interconnected level measuring devices and their location at decisive points on the machine. A relatively small number of hydrostatic level measuring devices, such as seven devices, make it possible to ascertain with the desired precision and in a very simple manner all the parameters decisive for the track position and its change caused by the ballast excavation, i.e. the superelevation in front and in the rear of the machine, the inclination of the ballast bed plane in the longitudinal direction, the lowering of the track in the regions of the left and right track rail as well as the excavating depth of the endless chain at both shoulders. In addition, this novel machine provides the operating personnel with very advantageous working conditions because the operator may concentrate on the observation of the operating equipment, particularly the excavating chain, and any obstacles encountered along the track after he has fed the predetermined parameters determining the track position into the automatic controls. The structure of the machine is very simple, highly dependable in operation, requires little space for the level measuring devices and is highly adaptable with respect to placing the conduit means between these devices. Therefore, it is possible to equip present mobile ballast cleaning machines with this apparatus at little cost.

The above and other objects, advantages and features of the present invention will become more apparent from the following detailed description of certain now preferred embodiments thereof, taken in conjunction with the accompanying schematic drawing wherein FIG. 1 is a generally diagrammatic side view of a mobile ballast cleaning machine equipped with the measuring apparatus of this invention;

Figure 1:
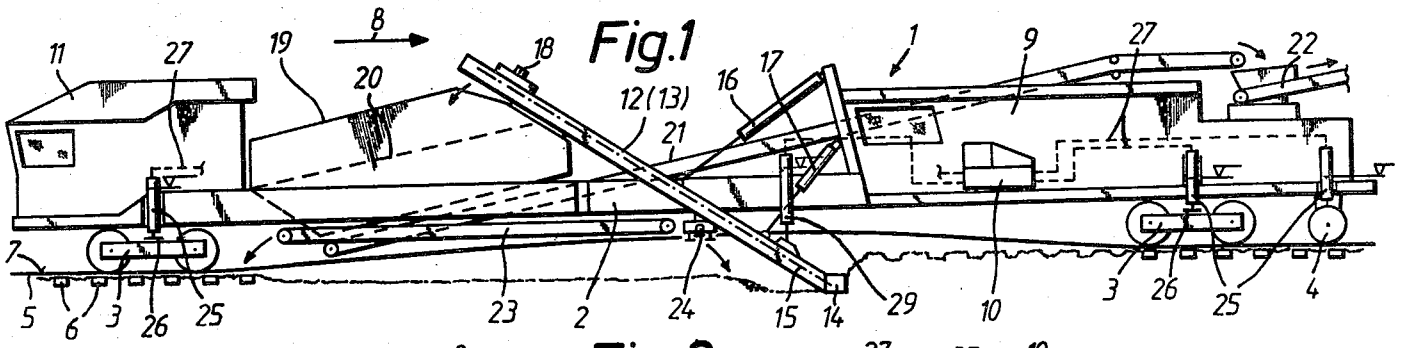

Referring now to the drawing and first to FIG. 1, there is shown mobile ballast cleaning machine 1 mounted on track 7 for movement in an operating direction indicated by arrow 8. Machine 1 comprises elongated frame having two laterally extending sides associated with the respective rails 5 of track 7. Front and rear undercarriages 3, 3 support frame 2 at respective ends of the frame on track 5. Conventional endless ballast excavating chain 15 is mounted on the frame and extends in an inclined plane with respect to track 7, the chain comprising course 14 extending transversely of the track and, during operation, therebelow, chain course 14 running under ties 6 of the track, and two lateral course 12 and 13 rising from transverse course 14 and merging at the top, the two lateral chain courses defining laterally outermost end regions of the chain where the lateral course merge into the transverse course. The endless ballast excavating chain moves in a suitable guide in a triangular path and hydraulic motor 18 is operated to drive the chain during the excavation. Power drive means constituted by hydraulic jacks 16 and 17 link the ballast excavating chain to frame 2 for vertically and transversely adjustably positioning the chain with respect to the frame. Means 19 incorporating ballast screen 20 is mounted on the machine frame for cleaning the ballast excavated by chain 15 and conveyor belt means 23 is arranged for redistributing the cleaned ballast under the track. Operator's cab 9 is mounted at the front end of frame 2, in relation to the operating direction, and this cab houses console 10 for the instruments which record and indicate the measured track and ballast bed parameters, in addition to the drive and other controls for the operation of the machine. Another operator's cab is mounted at the rear end of the machine frame.

The excavated ballast is carried by chain course 14 up along course 13 and is thrown in the range of hydraulic chain drive motor 18 into the cleaning mechanism 19, 20 where the waste is separated and removed by conveyor belt 21 and is deposited by a laterally pivotal short conveyor 22 on a track shoulder or is loaded in containers carried along on freight cars coupled to the machine. The cleaned ballast is redistributed to a large part, at least, by two laterally pivotal conveyor belts 23 and is deposited in the excavated bed immediately rearwardly of transverse chain course 14 in the range of track lifting means 24 mounted on the frame for lifting the machine frame above the track level. Any remaining cleaned ballast is redistributed through suitable discharge openings or chutes in the range of rear undercarriage 3 in the cribs. While ballast planing and compacting devices are usually provided on such machines, they have not been shown so as not to crowd the drawing unnecessarily with details of no significance to the present invention.

All of the above-described structure is conventional and the operation of such mobile ballast cleaning machines is very well known to those skilled in the art.

Figure 2:
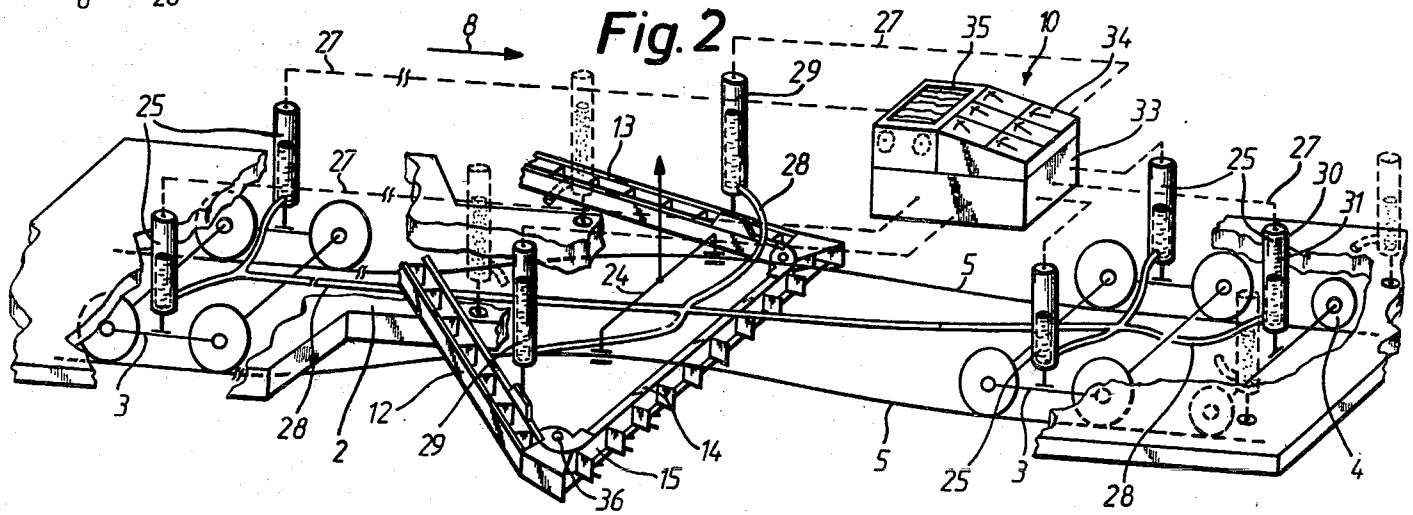
FIG. 2 is a somewhat diagrammatic perspective view showing a portion of the machine of FIG. 1 incorporating the measuring apparatus.

The machine is equipped with an apparatus providing a reference system for measuring and utilizing parameters characteristic of the track and track bed position, such as superelevation, inclination and lowering of the track and its bed. This reference apparatus comprises a number of hydrostatic level measuring devices 25, 29, seven being shown in the illustrated embodiment to indicate that even this small number of measuring devices suffices to obtain all the desired track parameters. As best shown in FIG. 2, two hydrostatic level measuring devices 25 are mounted in the region of front and rear undercarriages 3, 3 at each laterally extending side of frame 2, each pair of the devices at a respective undercarriage being so arranged that the measuring devices are opposite each other at the respective sides of the frame. Two further hydrostatic level measuring devices 29 are transversely spaced apart and mounted on the lateral courses near the laterally outermost regions of endless ballast excavating chain 15. Additional hydrostatic level measuring device 25 is mounted in the region of track sensing element 4 arranged on frame 2 forwardly of front undercarriage 3.

Track sensing element 4 comprises an axle and two sensing rollers engaging the track and running thereon, the additional hydrostatic level measuring device being mounted in the range of, and preferably on, the axle of the track sensing element which senses the track position of track 7 before the ballast bed has been reconditioned.

As shown in FIG. 2, console 10 comprises not only recording means 35 but preferably also indicating means 34 for the measured parameters.

For the sake of clarity, the size of level measuring devices 25 and 29 has been exaggerated in FIG. 2. The level measuring devices are constituted by intercommunicating vessels and conduit means 28, which may be flexible hoses, is common to all the level measuring devices and interconnects the devices for delivering a liquid thereto. As will be described further hereinafter, the devices comprise means for emitting electrical output signals corresponding to the measured parameters whereby the apparatus is capable of providing a reference base for the parameters superelevation, inclination and lowering of the track level. Common processing means 33 is mounted on console 10 for comparing the parameters and the parameters are recorded and indicated at 35 and 34. Common electrical circuit 27 connects all the devices 25 and 29 to respective inputs of the common processing means. This arrangement provides a common liquid level for all measuring devices so that the measured parameters may be interconnected in any desired manner without being subjected to any source of error resulting from liquid level differences if only respective pairs of measuring devices are interconnected.

The liquid may be delivered to the measuring devices through conduit 28 and the measuring devices may be emptied through suitable valves mounted in the conduit, neither the valves nor the liquid source being shown in the drawing for the sake of clarity. The common liquid level established in the intercommunicating measuring devices forms a geodetically exact and plane reference base independent of the track position and any fixed points, and this makes it possible exactly to measure the vertical distances thereof to the upper edge of the rails and to the lower edge of transverse excavating chain course 14. These vertical distances directly produce the desired track parameters by suitable coordination thereof.

As shown in the drawing, the two further hydrostatic level measuring devices 29 are arranged outside the ballast excavating range of transversely extending chain course 14 near the outer ends of this course. This will protect these measuring devices from damage and has the additional advantage of providing a very accurate measurement of the excavating depth and superelevation of the excavating chain due to the considerable transverse distance between the two measuring points.

As indicated in FIG. 1, hydrostatic level measuring devices 25 are vertically adjustably supported in vertical guides on frame. 2 and have a lower end directly supported on a respective one of undercarriages 3, 3 or track sensing element 4. The lower end may be connected to the undercarriage or the track sensing element. In the embodiment fully illustrated in FIG. 3, the lower end of the vertically adjustably supported hydrostatic measuring device has an extension 40 extending axially with respect to the device and having a ball-shaped gliding surface in contact with plate 26 rigidly connected to the undercarriage or track sensing element and extending perpendicularly to the extension so that the extension is glidingly supported on the plate. The vertically adjustable support of the level measuring devices assures a constant and unchanging distance between measuring device and track without the need for any mechanical transmission elements. On the other hand, the two further hydrostatic level measuring devices 29 are rigidly connected with ballast excavating chain 15 and this arrangement assures high accuracy in precision measurement and rapid determination of the differential measuring parameters.

As shown in FIG. 2, housing 30 of additional measuring device 25 mounted in the region of track sensing element 4 is transparent, for example of glass, and carries a scale 31 to enable liquid level 32 to be determined optically.

FIG. 2 furthermore shows in broken lines two more hydrostatic level measuring devices mounted on the frame in the region of lateral courses 12, 13 of the excavating chain. This arrangement of a total of four level measuring devices associated with the ballast excavating chain, which is universally movable by jacks 16 and 17 into a greater number of different positions, produces a particularly accurate measurement without any delay, which enables the measuring values for the required track parameters to be generated instantly to enable the operator to adjust the position of the excavating chain accordingly.

As also shown in broken lines in FIG. 2, two hydrostatic level measuring devices may be associated with the track sensing element, instead of one, in a manner similar to the arrangement on the undercarriages.

In the illustrated embodiment, the apparatus comprises a processing unit 33 for comparing and evaluating the measured values represented by the output signals of devices 25 and 29, an indicating unit 34 enabling the operator to read the measured values, which may be an analog indicating instrument or a digital indicator, and a recording unit 35 which may be a magnetic tape storage device or a graph writer, the units being combined into console 10.

As can be seen in FIG. 2, hydrostatic level measuring devices 25 and 29 comprise an elongated housing, the axial length of the housings of the two further devices 29 mounted near the laterally outermost regions of endless ballast excavating chain 15 exceeding that of the other measuring devices 25. This arrangement takes into account the different magnitudes of the relative movements of the undercarriages and track sensing element, on the one hand, and of the operating equipment, on the other hand, with respect to the liquid level in the measuring devices, which constitutes the reference base. In this way, it is possible to measure the relative level of transverse chain course 14 with respect to the reference base over the entire range of the vertical adjustment.

By suitably comparing the output signals of two or more measuring devices 25, 29 and processing them in a computer, as indicated by circuit 27 in FIG. 2, it is possible to obtain the following parameters and to indicate and record these parameters at units 34 and 35:

The track superelevation in front of the machine, as seen in the operating direction indicated by arrow 8.

The track superelevation behind the machine, as seen in this direction.

The inclination of the sub-grade.

The lowering of the track in the region of the right rail.

The lowering of the track in the region of the left rail.

The excavating depth in the right track shoulder.

The excavating depth in the left track shoulder.

These parameters characterize and confirm the result of the ballast bed cleaning operation and any track or ballast bed position errors with respect to the desired position.

Figure 3:
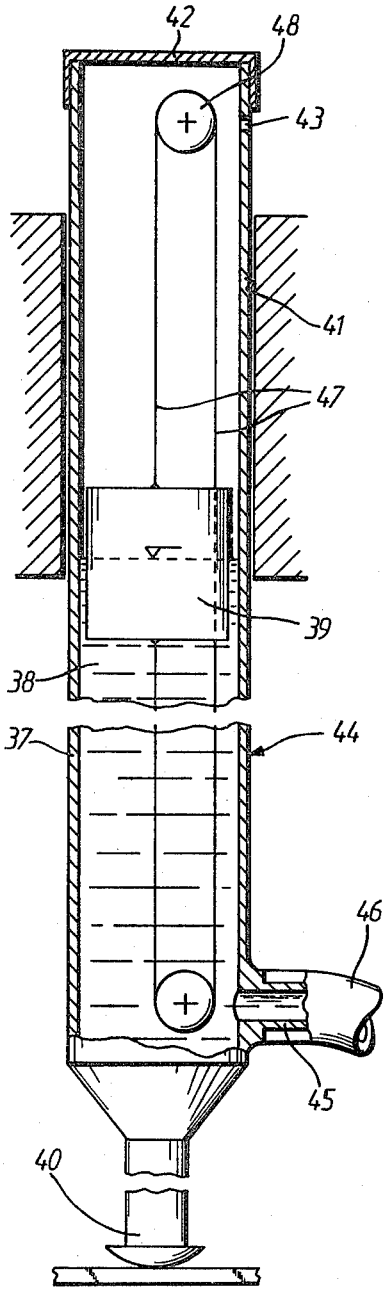
FIG. 3 is an enlarged axial section showing one of the hydrostatic level measuring devices used in the apparatus of FIGS. 1 and 2.

One preferred embodiment of a hydrostatic level measuring device is shown in FIG. 3. Device 44 is shown to be vertically adjustably supported in the machine frame and to comprise housing 37 defining float chamber 38. The housing is an elongated cylindrical tube freely glidably mounted in cylindrical guide bore 41 of the machine frame. Vertically movably floating gage 39 is arranged in floating chamber 38. Elongated endless cable pulley 47 extends in an axial direction in housing 37 and the cable is connected to floating gage 39. Means for emitting electrical output signals corresponding to the measured parameters, i.e. the position of floating gage 39 in float chamber 38, which is a direct function of the liquid level therein, is affixed to housing 37 and is connected to the floating gage for movement therewith. In the illustrated embodiment, this signal emitting means is a rotary potentiometer coupled to upper pulley 48 of the cable pulley. The lower end of measuring device 44 has extension 40 extending axially with respect to the device and the undercarriage or track sensing element comprises a plate rigidly connected thereto and extending perpendicularly to extension 40, the extension being glidingly supported on the plate. In the illustrated embodiment, extension 40 has a ball-shaped gliding surface in contact with the plate. The upper end of housing 37 is covered by closure 42 and the housing defines venting port 43 near the top thereof for venting the space in the housing above the liquid level. The lower end of housing 37 carries connection 45 for receiving flexible liquid delivery hose 46 which forms part of the conduit means interconnecting the level measuring devices of the apparatus of this invention. As the floating gage moves vertically in response to the liquid level in the float chamber, the cable connected thereto will move to turn pulley 48 and the rotary potentiometer connected thereto, this causing the potentiometer to emit output signals corresponding to the liquid level.

The above-described construction of the level measuring device assures uniform measuring conditions for all devices. It enables the devices to use rotary potentiometers as signal emitters for the measured parameters and these instruments have proven to be very dependable and accurate in a number of track measuring operations, due to their linear characteristics. The above-described and illustrated gliding support of the lower end of measuring device 44 on a plate affixed to the undercarriage is particularly useful for ballast cleaning machines whose frames are supported on swivel trucks or undercarriages with laterally movable wheels because the relative vertical position of the level measuring devices with respect to the running surface of the rail head always remains constant despite the pivoting or lateral movements of the undercarriages with respect to the machine frame in track curves. The rotary potentiometer may be coupled to the pulley of cable drive 47 through a reduction gear. Mounting the movable parts of the measuring device inside the housing protects these parts and makes it possible freely to select the ratio of the floating gage path and the resistance range of the potentiometer.

Figure 4:
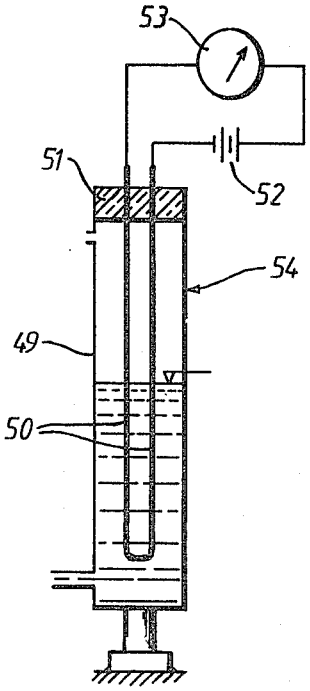
FIG. 4 is a similar view, on a smaller scale, of another embodiment of a hydrostatic level measuring device useful in this apparatus.

FIG. 4 illustrates an embodiment of a level measuring device using no movable parts for measuring the liquid level in the device and requires only that the liquid medium in the device is electrically conductive. Water or mercury are particularly useful for this purpose. Measuring device 54 comprises cylindrical housing 49 holding an electrically conductive liquid. Elongated electrical resistance element 50 extends in an axial direction in housing 49 and is electrically insulated from the housing. For this purpose, the terminals of the electrical resistance element, which is a loop element in the embodiment of FIG. 4, are led out of housing 49 through electrically insulating cover 51 closing the upper end of the housing. Electrical measuring 52, 53 is connected to resistance element 50 and this circuit comprises current source 52 and indicating instrument 53. The resistance element is immersed in the conductive liquid for connection to the electrical measuring circuit. Depending on the liquid level, a longer or shorter portion of resistance element 50 is covered by the conductive liquid, thus changing the resistance value in direct proportion to the liquid level changes. The indicating instrument 53 may be suitably calibrated to indicate the vertical level measurements directly, for instance in millimeters. The lower end of measuring device 54 may be rigidly affixed to the excavating chain or to the machine frame.

Figure 5:
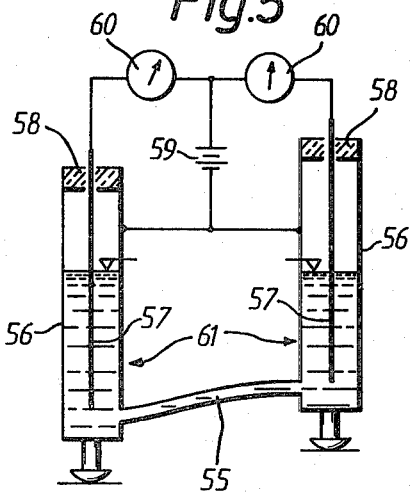
FIG. 5 is a simplified circuit diagram showing a pair of hydrostatic level measuring devices of yet another embodiment of this invention.

FIG. 5 illustrates an associated pair of level measuring devices 61 each comprising housing 56. In this embodiment, each elongated electrical resistance element is a single element 57 centrally arranged in the housing and insulated therefrom by electrically insulating housing cover 58. The housings are made of an electrically conductive material and are electrically connected to one pole of current source 59. The other pole of the current source is connected to indicating instruments 60 which receive the output signal of resistance elements 57 connected thereto. The interiors of housings 56 communicate through conduit 55 so as to provide a common liquid level in the housings.

In this manner, each level measuring device 61 has its own electrical measuring circuit closed by electrically conductive housings 56, the electrically conductive liquid in the housings and resistance elements 57. If desired, the difference between the two measured levels, for example the vertical positions of the left and right rails, may be indicated and recorded as a superelevation parameter on a single indicating and/or recording instrument.

All the embodiments of this invention have in common the continuous measurement and recording of the track parameters of interest independently of the location and the possibility of controlling the position of the ballast excavating chain continuously and automatically in response to the measured parameters so that the cleaned ballast bed and the track supported thereon will come as close as desired to the desired position.

What is claimed is:

1. A mobile ballast cleaning machine mounted on a track for movement in an operating direction and comprising (a) an elongated frame having two laterally extending sides, (b) a front undercarriage and a rear undercarriage supporting the frame at respective ends thereof on the track, (c) track lifting means mounted on the frame, (d) an endless ballast excavating chain mounted on the frame and extending in an inclined plane with respect to the track, the chain comprising (1) a course extending transversely of the track and, during operation, therebelow, the endless ballast excavating chain having laterally outermost end regions, and (2) two lateral courses rising from the end regions in the inclined plane, (e) power drive means linking the ballast excavating chain to the frame for vertically and transversely adjustably positioning the chain with respect to the frame, (f) means for cleaning the ballast excavated by the chain and for redistributing the cleaned ballast under the track, (g) a track sensing element arranged on the frame forwardly of the front undercarriage, in the operating direction, and (h) apparatus for continuously measuring parameters indicating the track position and any changes therein with respect to a reference system caused by the ballast excavation, and for recording the measured parameters, the measuring and recording apparatus comprising (1) hydrostatic level measuring devices mounted in the region of the front and rear undercarriages at the laterally extending sides of the frame, (2) two further hydrostatic level measuring devices transversely spaced apart and mounted on the lateral courses near the laterally outermost regions of the endless ballast excavating chain, (3) an additional hydrostatic level measuring device mounted in the region of the track sensing element, and (4) conduit means connected to the hydrostatic level measuring devices for delivering a liquid thereto, the devices comprising means for emitting electrical output signals corresponding to the measured parameters whereby the apparatus is capable of providing a reference base for the parameters superelevation, inclination and lowering of the track level.

2. The mobile ballast cleaning machine of claim 1, wherein the apparatus further comprises means for indicating the measured parameters.

3. The mobile ballast cleaning machine of claim 1 or 2, wherein the track sensing element comprises an axle and two sensing rollers engaging the track and running thereon, the additional hydrostatic level measuring device being mounted in the range of the axle.

4. The mobile ballast cleaning machine of claim 1 or 2, wherein the conduit means is common to all of said level measuring devices and interconnects said devices, and further comprising a common means for processing the measured parameters and a common electrical circuit connecting the devices to the common processing means.

5. The mobile ballast cleaning machine of claim 1, wherein the two further hydrostatic level measuring devices are arranged outside the ballast excavating range of the transversely extending chain course.

6. The mobile ballast cleaning machine of claim 1 wherein the first named hydrostatic level measuring devices are vertically adjustably supported on the frame and have a lower end directly supported on a respective one of the undercarriages.

7. The mobile ballast cleaning machine of claim 6, wherein the lower end is connected to the respective undercarriage.

8. The mobile ballast cleaning machine of claim 6 or 7, wherein each vertically adjustably supported hydrostatic level measuring device comprises a housing defining a float chamber and vertically adjustably mounted on the frame, a vertically movable floating gage being arranged in the float chamber.

9. The mobile ballast cleaning machine of claim 8, wherein the means for emitting the electrical output signals is affixed to the housing and is connected to the floating gage for movement therewith.

10. The mobile ballast cleaning machine of claim 9, wherein the output signal emitting means is a potentiometer.

11. The mobile ballast cleaning machine of claim 10, further comprising an elongated endless cable pulley extending in an axial direction in said housing and connected to the floating gage, the potentiometer being a rotary potentiometer coupled to the cable pulley.

12. The mobile ballast cleaning machine of claim 6, wherein each lower end of the vertically adjustably supported hydrostatic level measuring device has an extension extending axially with respect to the device and the undercarriage comprises a plate rigidly connected thereto and extending perpendicularly to the extension, the extension being glidingly supported on plate.

13. The mobile ballast cleaning machine of claim 12, wherein the extension has a ball-shaped gliding surface in contact with the plate.

14. The mobile ballast cleaning machine of claim 1, wherein at least one of the hydrostatic level measuring devices comprises a housing holding the liquid, and further comprising an elongated electrical resistance element extending in an axial direction in said housing and being electrically insulated from the housing, and an electrical measuring circuit connected to the resistance element.

15. The mobile ballast cleaning machine of claim 14, wherein resistance element is a loop element.

16. The mobile ballast cleaning machine of claim 14, wherein the resistance element is a single elongated element.

17. The mobile ballast cleaning machine of claim 15, wherein the resistance element is immersed in the liquid for connection to the electrical measuring circuit.

18. The mobile ballast cleaning machine of claim 1, wherein the hydrostatic level measuring devices comprise elongated housings, the axial length of the housings of the two further hydrostatic level measuring devices exceeding that of the other devices.

19. The mobile ballast cleaning machine of claim 1, wherein the apparatus comprises only seven hydrostatic level measuring devices, one respective one of the devices being mounted in the region of the undercarriages at a respective laterally extending side of the frame, one respective one of the further devices being mounted near each laterally outermost region of the endless ballast excavating chain, and one additional hydrostatic level measuring device being mounted in the region of the track sensing element.

20. The mobile ballast cleaning machine of claim 1, wherein the apparatus comprises two more hydrostatic level measuring devices mounted on the frame in the region of the lateral course of the excavating chain.

* * * * *